US007034772B2

(12) United States Patent
Woodward

(10) Patent No.: US 7,034,772 B2
(45) Date of Patent: Apr. 25, 2006

(54) FLEXIBLE MULTI-CLADDED METALLIC TAPE FOR FORMING PARABOLIC SHAPED MAGNETIC FIELD AND ENERGY DEFLECTING DEVICES

(76) Inventor: Lloyd Harold Woodward, 8005 Matt Ct., Dunn Loning, VA (US) 22027-1001

( * ) Notice: Subject to any disclaimer, the term of this patent is extended or adjusted under 35 U.S.C. 154(b) by 393 days.

(21) Appl. No.: 10/666,009

(22) Filed: Sep. 21, 2003

(65) Prior Publication Data

US 2005/0001774 A1 Jan. 6, 2005

Related U.S. Application Data

(60) Provisional application No. 60/412,364, filed on Sep. 20, 2002.

(51) Int. Cl.
*H01Q 1/52* (2006.01)

(52) U.S. Cl. ..... 343/841; 343/702; 343/700 MS

(58) Field of Classification Search ..... 343/841, 343/700 MS, 702, 872; 455/90
See application file for complete search history.

(56) References Cited

U.S. PATENT DOCUMENTS 5,373,304 A * 12/1994 Nolan et al. ..... 343/841
5,777,586 A * 7/1998 Luxon et al. ..... 343/702
6,249,256 B1 * 6/2001 Luxon et al. ..... 343/702

* cited by examiner

*Primary Examiner*—Hoang V. Nguyen

(57) ABSTRACT

A flexible multi-layered metallic tape for deflecting and blocking the RF radiation emitted by various antennas, particularly those used on cellular telephones, satellite telephones or military field radio-phones. Shaping of device around antenna causes multiple effects, including protecting the human user from harmful radiation, for military applications makes RF hard to DF and causes minor amplification of received signals by concentrating them on to antenna. The outer most part of the deflector shield should be made of a solid lead or gold tape that is six thousandths thick and ½" wide wherein a 1" length would weigh ¼ gram. The outer most part would have an insulating flexible adhesive for cladding it to the next inner part. The first inner part of the shield should be made of solid copper foil. Best results coming from a foil that is at least three thousandths thick. Aside from having the outer most part cladded in parallel to it, it would have an insulating flexible adhesive for cladding it to the next inner part. The second inner part layer should be formed from 80 mesh 100% copper metal fabric; as shown in the drawing FIG. 3—Part 3. Aside from having the first inner part cladded in parallel to it, it would have an insulating flexible adhesive for attaching the shield to the mobile telephone, covered by a non-stick peel-off paper.

3 Claims, 4 Drawing Sheets

American Telecom Devices FCC ID: HDT56ZF1 – AMPS Head SAR
SAM Phantom; Flat Section; Probe:ET3DV6 - SN1677; ConvF(6.40,6.40,6.40)
Med. Parameters 835 MHZ Muscle: $\sigma$ = 0.99 mho/m $\varepsilon_r$ = 56.1 $\rho$ = 1.00 g/cm$^3$; Antenna Position -- In; Crest Factor 1.0
SAR (1g): 4.11 mW/g, SAR (10g): 2.38 mW/g Motorola TriMode Phone Model: StarTac
AMPS Mode, Ch.0383 [836.49MHZ]; Standard Battery; Ambient Temp. = 19.9°C / Meas. Tissue Temp. = 19.1 °C
Conducted Power=24.5dBm; 0.0cm from back (antenna side) of EUT to flat phantom, No Belt Clip/No Holster
Test Date – 11/12/2002 [FCC/OET Bulletin 65 - Supplement C, July 2001]

Figure 6

American Telecom Devices FCC ID: HDT56ZF1 – AMPS Head SAR
SAM Phantom; Flat Section; Probe:ET3DV6 - SN1677; ConvF(6.40,6.40,6.40)
Med. Parameters 835 MHz Muscle: $\sigma$ = 0.99 mho/m $\varepsilon_r$ = 56.1 $\rho$ = 1.00 g/cm$^3$; Antenna Position – In; Crest Factor 1.0
SAR (1g): 0.648 mW/g, SAR (10g): 0.327 mW/g Motorola TriMode Phone Model: StarTac
AMPS Mode, Ch.0383 [836.49MHz]; Standard Battery; Ambient Temp. = 19.9°C / Meas. Tissue Temp. = 19.1°C
Conducted Power = 24.5dBm; 0.0cm from back (antenna side) of EUT to flat phantom, No Belt Clip/No Holster
Test Date – 11/12/2002 [FCC/OET Bulletin 65 - Supplement C, July 2001]

Figure 7

FLEXIBLE MULTI-CLADDED METALLIC TAPE FOR FORMING PARABOLIC SHAPED MAGNETIC FIELD AND ENERGY DEFLECTING DEVICES

The application claims benefit of 60/412,364 dated 20 Sep. 2002.

BACKGROUND OF THE INVENTION

Mobile telephones operating in an analog mode produce radiation, which has been proven to affect the user's health. Modern mobile telephones operating in digital mode only generate 1/10 of the radiation of the older analog mobile telephones. However, most mobile telephones (specifically cellular telephones) do not have sufficiently good connection with their transmitting towers to stay in the digital mode of operation. Even the newest cellular telephones are dual mode or tri-mode telephones, with the fallback mode of operation being analog. In the fall-back mode of operation (analog), the cellular telephone using it's ability to control an internal rheostat increases it's power radiation by a factor of eight to twelve times over it's digital mode of operation.

The long-term health effects would probably not have shown up for ten to twenty years, except radiation effects are cumulative and today's user is exposing themselves for much longer periods of time than was true when mobile telephones first came into use. Today children are using mobile telephone plans that provide thousands of minutes per month—and they are using them. This extended use will increase the number of health related problems from cellular telephone use and will change the risk profiles of health related statistics.

The Good Housekeeping Institute released a report on cell telephone shields, based on tests conducted by Intertek Testing Services. The test results showed that all of those shields tested were not effective at blocking the radiation from cellular telephones. Good Housekeeping filed formal complaints with the FTC against these manufacturers and the FTC subsequently sued the shield manufacturers for false advertising to stop them from selling non-functional shields.

Mobile telephone transmitting antennas radiate Radio Frequency (RF) energy omni-directionally. This RF for most mobile telephones is in the microwave range of the energy spectrum. Also, as each RF wave leaves the antenna, an accompanying magnetic wave also is generated.

The new SAR ratings that Cell Phone Manufacturers are now forced to disclose are measurements of this energy absorbed as heat coming off the transmitting antennas of mobile telephones into the users head. SAR stands for Specific Absorption Rate, which is a measure of the amount of heat that reaches sensors placed in the middle of a human skull packed with gel, to approximate the density of the human brain, as depicted in FIG. 1.

A question that has surfaced recently concerns the effects on our children. A child's skull is less dense than an adult's, so radiation tunnels deeper into their brains; and a child's brain is still developing, so mutation of the DNA at the basic blood cell level is worse for a child.

SUMMARY OF THE INVENTION

It is very desirable to have a device that reduces both the RF and magnetic field problems of mobile telephones and improves their transmission. A device that deflects the magnetic field generated by the transmitting antenna and deflects the RF microwave away from the mobile telephone user's head. The drawing in FIG. 2 shows the effect of a flexible tape on device formed as a parabolic half cylinder around the cellular telephone's transmitting antenna. The prototype flexible nested parabolic deflector device can deflect 100% of the magnetic field that would radiate the skull and deflects 100% of the microwave RF energy, without adversely effecting the operation of the cell phone. FIGS. 6 and 7 show the FCC standard test report results of an engineering prototype tested by an FCC certified laboratory, PCTest Engineering Services, Inc., wherein the transmitting antenna of the mobile telephone was not shielded (FIG. 6) and where approximately 75% of the transmitting antenna was shielded (FIG. 7).

BRIEF DESCRIPTION OF THE DRAWINGS

In drawings which illustrate embodiments of the invention,

FIG. 6 is the reproduction of an FCC certified laboratory report—FCC report number HDT56ZF1—showing the SAR of an unshielded typical cellular telephone; and FIG. 7 is the reproduction of an FCC certified laboratory report—FCC report number HDT56ZF1—showing the SAR of the same cellular telephone with the invention installed.

DETAILED DESCRIPTION OF THE PREFERRED EMBODIMENTS

Figure 1:
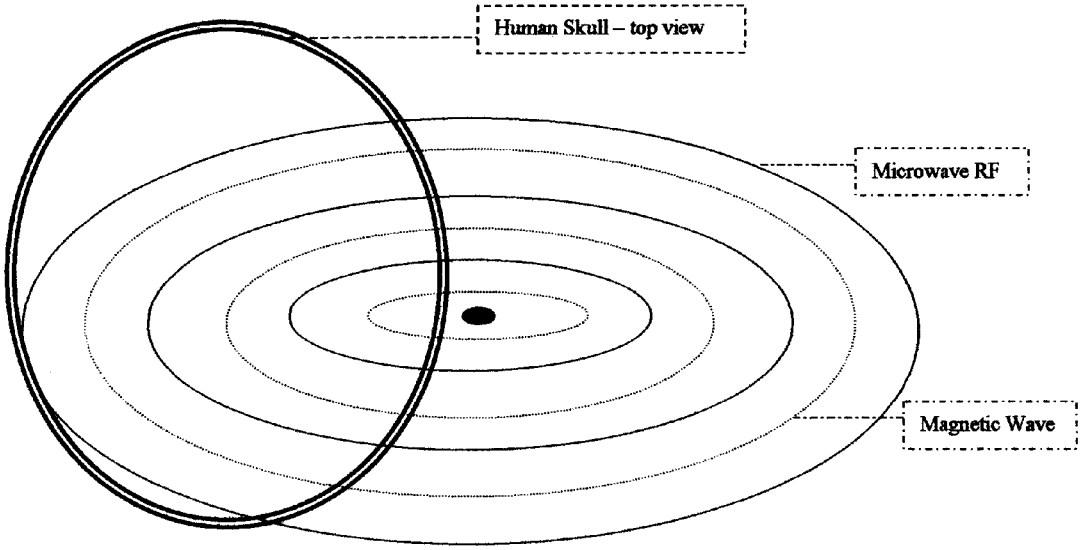
FIG. 1 is a top down view of the magnetic wave and RF radiation from a typical omni-directional antenna held in close proximity to the user's head.
Figure 2:
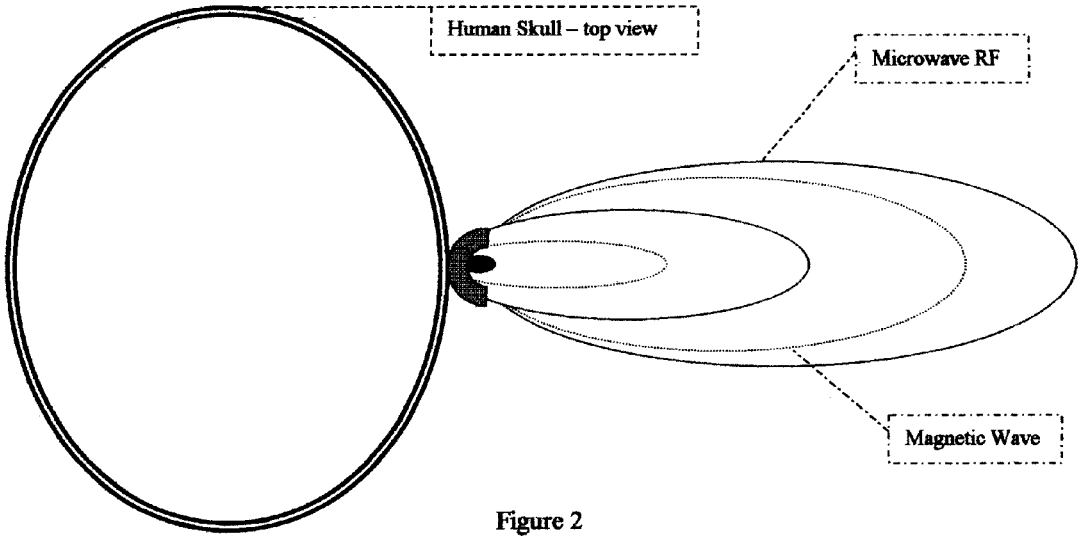
FIG. 2 is a top down view of the magnetic wave and RF radiation from a typical omni-directional antenna held in close proximity to the user's head with the invention in use.

The outer most part of the deflector shield should be made of a solid lead or gold tape that is six thousandths thick and ½" wide wherein a 1" length would weigh ¼ gram. As shown in the drawing FIG. 3—Part 1, it would have an insulating flexible adhesive for cladding it to the next inner part. The first inner part of the shield should be made of solid copper foil. Best results coming from a foil that is at least three thousandths thick, as shown in the drawing FIG. 3—Part 2. Aside from having the outer most part cladded in parallel to it, it would have an insulating flexible adhesive for cladding it to the next inner part. The second inner part layer should be formed from 80 mesh 100% copper metal fabric; as shown in the drawing FIG. 3—Part 3. Aside from having the first inner part cladded in parallel to it, it would have an insulating flexible adhesive for attaching the shield to the mobile telephone, covered by a non-stick peel-off paper.

The attachment should be accomplished such that the shield encompasses the full 180 degrees of the semi-circle of one half of the base of the cellular telephone's antenna. On most mobile telephones this shields most of the transmitting antenna for "after market" use. If designing into a mobile telephone the shield should encompass as half of a cylinder the entire 180 degrees half of the transmitting antenna closest to the mobile telephone user's head. The outer most part of this multi-layered tape and it's edges should be covered with a flexible plastic coating to protect the user from potential problems with the lead tape.

Figure 4:
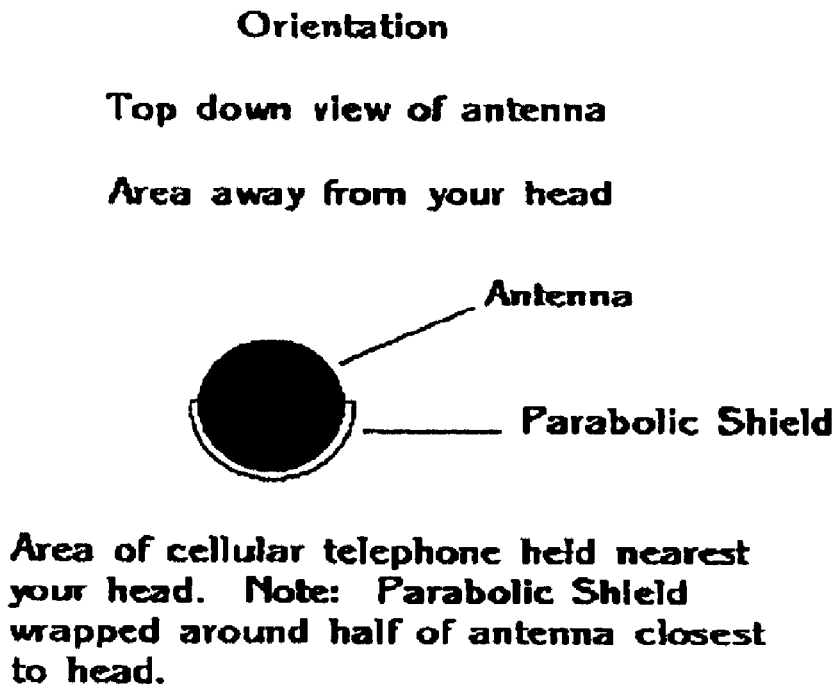
FIG. 4 is a top down view of how the invention would be oriented/installed on an omni-directional antenna.

Because mobile telephones have different sized antennas, the shield would need to be made to encircle one half of the largest antenna on the market (should be under one inch). Trimming the length to encompass one half of the mobile telephones antenna would easily accommodate mobile telephones with smaller diameter antennas. The shield would be applied as shown in FIG. 4.

Figure 5:
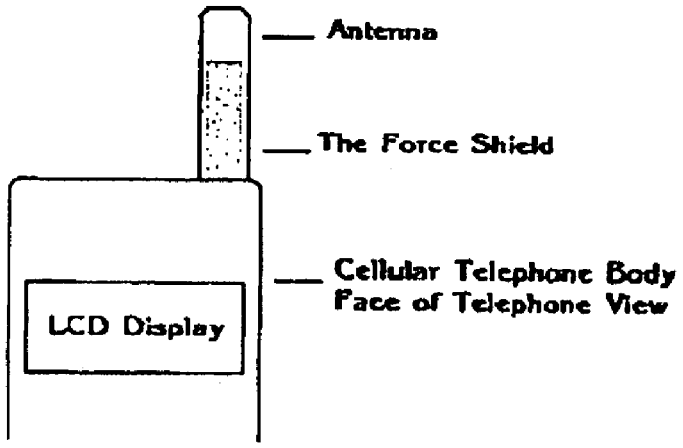
FIG. 5 is a face on view of placement of the invention on a typical cellular telephone with an external omni-directional antenna.

This flexible deflector shield would be effective with either being built-in on a new mobile telephone or added on to the outside of an "after market" mobile telephone. The difference is that being built-in the shield would be close to 100% effective in deflecting microwave radiation. However, when installed as an "after market" product the effectiveness may only be 85% because the mobile telephone manufacturers have sunk the transmitting antenna partially into the body of some of the mobile telephones to reduce their SAR test numbers. The most effective method of installing the shield is shown in FIG. 5.

Figure 3:
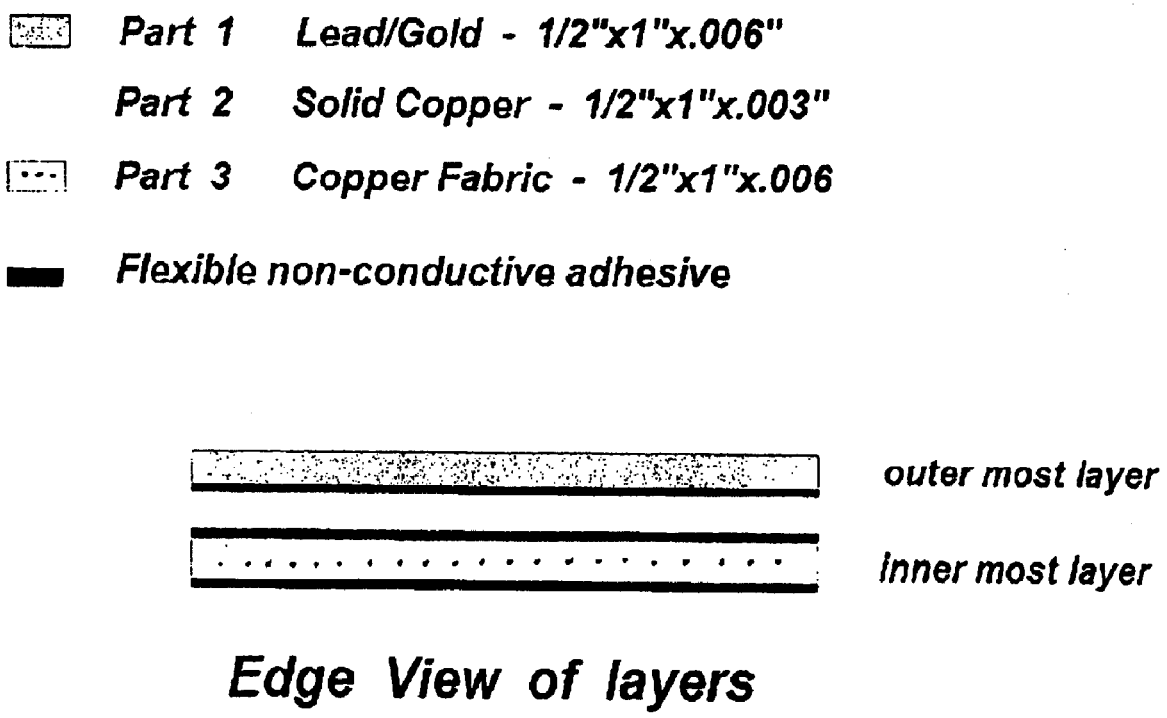
FIG. 3 is an edge view of the cladded layers of metallic tape, which form the basic deflecting shield.

The parts shown in FIG. 3 clad onto one another, with Part 1 having Part 2 cladded to it in parallel, then Part 3 cladded to Part 2's other side in parallel. Then the edges and outer most part would be coated with a flexible plastic to form an assembled device. Part 1 could be gold or lead, both stop radiation, but because of cost lead would be the logical choice for manufacture.

I claim:

1. The unique invention of nesting and cladding together a flexible metallic tape that when shaped as a parabolic half cylinder around a transmitting antenna will deflect the generated magnetic field and the microwave Radio Frequency (RF), wherein the device is composed of an outer most ribbon of lead tape whose inside area has an insulating layer of adhesive and further has cladded inside thereof a parallel ribbon of solid copper whose inside area has an insulating layer of adhesive and further has cladded inside thereof a parallel ribbon of woven 80 mesh copper fabric whose inside area has a layer of adhesive protected by a peel-off non-stick piece of paper; with all of the sides and outer most ribbon of lead coated with a flexible plastic to protect the mobile telephone user from the lead in this device.

2. Claims the device described in 1 above, wherein the lead tape is gold, an alloy, or metal which would have the same or less characteristics for blocking radiation and wherein the solid copper and/or woven copper fabric could be replaced with any other metal or alloy in the same manner and to the same or different gauge.

3. Claims the device described in 1 above, wherein the dimensions of the device have been increased or decreased to allow it's use on large RF antennas or small RF antennas, which may radiate significantly increased RF or may radiate significantly less RF or may radiate within a different part of the Electro Magnetic spectrum; or wherein the attaching mechanism is a clip or anything other than an adhesive.

* * * * *